US008797137B2

(12) United States Patent
Watanabe et al.

(10) Patent No.: US 8,797,137 B2
(45) Date of Patent: Aug. 5, 2014

(54) SOFT MAGNETIC POWDER, GRANULATED POWDER, DUST CORE, ELECTROMAGNETIC COMPONENT, AND METHOD FOR PRODUCING DUST CORE

(75) Inventors: Asako Watanabe, Itami (JP); Toru Maeda, Itami (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 102 days.

(21) Appl. No.: 13/505,003

(22) PCT Filed: May 17, 2011

(86) PCT No.: PCT/JP2011/061304

§ 371 (c)(1),
(2), (4) Date: Apr. 30, 2012

(87) PCT Pub. No.: WO2011/148826

PCT Pub. Date: Dec. 1, 2011

(65) Prior Publication Data

US 2012/0229245 A1 Sep. 13, 2012

(30) Foreign Application Priority Data

May 28, 2010 (JP) ..... 2010-123327
Apr. 21, 2011 (JP) ..... 2011-094804

(51) Int. Cl.

| | |
|---|---|
| ***H01F 27/24*** | (2006.01) |
| ***H01F 27/02*** | (2006.01) |
| ***H01F 5/00*** | (2006.01) |
| ***H01F 1/00*** | (2006.01) |
| ***H01F 1/04*** | (2006.01) |
| ***C22C 38/06*** | (2006.01) |
| ***H01F 1/33*** | (2006.01) |
| ***H01F 1/24*** | (2006.01) |
| ***H01F 41/02*** | (2006.01) |
| ***C22C 38/08*** | (2006.01) |
| ***C22C 38/02*** | (2006.01) |
| ***C22C 38/00*** | (2006.01) |
| ***C22C 38/04*** | (2006.01) |
| *H01F 3/08* | (2006.01) |

(52) U.S. Cl.

CPC ..... *C22C 38/02* (2013.01); *C22C 38/06* (2013.01); *H01F 1/33* (2013.01); *H01F 1/24* (2013.01); *C22C 2202/02* (2013.01); *H01F 41/0246* (2013.01); *C22C 38/08* (2013.01); *H01F 3/08* (2013.01); *C22C 38/002* (2013.01); *C22C 38/04* (2013.01)

USPC ..... 336/233; 336/83; 336/200; 148/306; 252/62.51 R; 252/62.55

(58) Field of Classification Search

USPC ..... 336/83, 200, 233; 148/306; 252/62.51–62.56

See application file for complete search history.

(56) References Cited

U.S. PATENT DOCUMENTS

| | | | | |
|---|---|---|---|---|
| 6,120,916 | A * | 9/2000 | Delvinquier et al. | 428/838 |
| 2004/0209120 | A1* | 10/2004 | Inoue et al. | 428/694 B |
| 2006/0066432 | A1* | 3/2006 | Inuzuka | 336/200 |
| 2008/0044679 | A1* | 2/2008 | Maeda et al. | 428/546 |
| 2010/0033284 | A1* | 2/2010 | Yamakami et al. | 336/192 |

FOREIGN PATENT DOCUMENTS

| | | | |
|---|---|---|---|
| JP | 2004-319652 | A | 11/2004 |
| JP | 2005-142308 | A | 6/2005 |
| JP | 2007-012745 | A | 1/2007 |
| JP | 2008277775 | A * | 11/2008 |
| JP | 2009084645 | A * | 4/2009 |

OTHER PUBLICATIONS

International Seach Report for PCT Application No. PCT/JP2011/061304 dated Aug. 23, 2011, pp. 1.

Yanagimoto et al. "Effect of Si and Al Content on Core Loss in Fe—Si—Al Powder Cores", IEEE Transactions on Magnetics, vol. 40, No. 3, pp. 1691-1694 (May 2004).

Korean Office Action for Corresponding Application No. 10-2012-7009707, mailed Sep. 26, 2013.

* cited by examiner

*Primary Examiner* — Tsz Chan
(74) *Attorney, Agent, or Firm* — Ditthavong & Steiner, P.C.

(57) ABSTRACT

Provided is a soft magnetic powder used for obtaining a dust core having a low hysteresis loss, in particular, in a high temperature range. A soft magnetic powder includes an aggregate of composite magnetic particles, each including a soft magnetic particle containing Fe, Si, and Al, and an insulating coating film disposed on the surface thereof, and satisfies the expressions (1) and (2) below: Expression (1) . . . $27 \leq 2.5a+b \leq 29$ and Expression (2) . . . $6 \leq b \leq 9$, where a represents the Si content (mass %) and b represents the Al content (mass %). The soft magnetic powder is capable of reducing the hysteresis loss, in a high-temperature environment, of a dust core obtained using the soft magnetic powder.

11 Claims, 2 Drawing Sheets

SOFT MAGNETIC POWDER, GRANULATED POWDER, DUST CORE, ELECTROMAGNETIC COMPONENT, AND METHOD FOR PRODUCING DUST CORE

TECHNICAL FIELD

The present invention relates to a soft magnetic powder, a granulated powder obtained by granulation of the soft magnetic powder, a dust core using a granulated powder, an electromagnetic component using a dust core, and a method for producing a dust core.

BACKGROUND ART

Inductors, typical examples of which include choke coils, are used in energy conversion circuits, such as switching power sources and DC/DC converters. As a structural example of an inductor, there is known an inductor which includes a dust core obtained by firing a soft magnetic powder compact and a coil obtained by winding a winding wire around the dust core.

The dust core is, for example, fabricated as follows (e.g., refer to PTL 1 or the like). First, a soft magnetic powder, which is an aggregate of composite magnetic particles, each including a soft magnetic particle and an insulating coating film provided on the surface thereof, is prepared. Then, the soft magnetic powder is compacted into a predetermined shape, and the resulting compact is heat-treated to produce a dust core. It is described that, in a dust core obtained by such a method, insulation between the soft magnetic particles is secured by insulating coating films of silicon oxide, and even when a large direct current is superimposed, the inductance is not decreased excessively.

Properties required for a dust core include a reduction in an energy loss referred to as "iron loss". Iron loss is roughly represented by a sum of eddy current loss and hysteresis loss, and in particular, becomes noticeable in high-frequency use. The eddy current loss in the iron loss can be reduced by ensuring that there is insulation between the soft magnetic particles. On the other hand, the hysteresis loss can be reduced by adjusting the composition of the soft magnetic particles. For example, Fe—Si—Al alloys, i.e., sendust alloys, can reduce the hysteresis loss of dust cores and also can improve the relative magnetic permeability of dust cores, and therefore, they are suitably used as soft magnetic particles.

CITATION LIST

Patent Literature

PTL 1: JP2004-319652A

SUMMARY OF INVENTION

Technical Problem

However, in recent years, with the increasing interest in energy issues, properties required for a dust core have been becoming stricter, and development of dust cores having lower energy loss has been desired. In particular, converters and the like mounted in hybrid automobiles and the like, which have been showing remarkable development recently, are operated in a high temperature range of 100° C. or higher. Consequently, dust cores used for converters are also required to have a low energy loss in that temperature range.

The present invention has been achieved under the circumstances described above. It is an object of the present invention to provide a soft magnetic powder and a granulated powder used for obtaining a dust core having a low hysteresis loss, in particular, in a high temperature range.

It is another object of the present invention to provide a method for producing a dust core having a low hysteresis loss, in particular, in a high temperature range, and to provide an electromagnetic component using the dust core.

Solution to Problem

[Soft Magnetic Powder]

A soft magnetic powder of the present invention includes an aggregate of composite magnetic particles, each including a soft magnetic particle containing Fe, Si, and Al, and an insulating coating film disposed on the surface thereof, and satisfy the expressions (1) and (2) below:

$$27 \leq 2.5a+b \leq 29 \quad \text{Expression (1)}$$

$$6 \leq b \leq 9 \quad \text{Expression (2)}$$

where a character a represents the Si content (mass %) and a character b represents the Al content (mass %) in the soft magnetic particles.

In the case of the soft magnetic powder having the constitution described above, it is possible to reduce the energy loss, in particular, the hysteresis loss in a high-temperature environment, of a dust core obtained using the soft magnetic powder. In particular, by further limiting a representing the Si content and b representing the Al content so as to satisfy the expressions (3) and (4) below, the hysteresis loss of the dust core can be further reduced.

$$978/35 \leq 18/7a+b \leq 1023/35 \quad \text{Expression (3)}$$

$$6.6 \leq b \leq 8.4 \quad \text{Expression (4)}$$

According to an embodiment of the soft magnetic powder of the present invention, in the soft magnetic particles, preferably, the O content is less than 0.2 mass % (including 0 mass %), the Mn content is 0.3 mass % or less (including 0 mass %), and the Ni content is 0.3 mass % or less (including 0 mass %).

By decreasing the O content, the Mn content, and the Ni content in the soft magnetic particles in the soft magnetic powder, the hysteresis loss in a high-temperature environment of a dust core obtained using the soft magnetic powder can be effectively reduced.

According to an embodiment of the soft magnetic powder of the present invention, preferably, the insulating coating film disposed on the surface of each soft magnetic particle includes an inorganic insulating layer composed of an inorganic substance containing Si and O.

In such a constitution, when a dust core is produced using the soft magnetic powder, the insulating coating film is not easily damaged in the step of pressing the powder. Consequently, in the resulting dust core, insulation between the soft magnetic particles is sufficiently secured, and it is possible to obtain a dust core having a high magnetic permeability and a low iron loss (low hysteresis loss).

[Granulated Powder]

A granulated powder of the present invention is formed into a compact by pressing, the compact being fired into a fired body for forming a magnetic core, and includes the soft magnetic powder of the present invention described above and a molding resin which serves as a shape-retaining agent during forming to retain the shape of the compact. The granulated powder of the present invention is characterized in that the soft magnetic powder and the molding resin are combined into a granular form.

In the granulated powder having such a constitution, it is possible to obtain a dust core having a low energy loss, in particular, a low hysteresis loss in a high-temperature environment. As the molding resin, for example, an acrylic resin is preferable. In the case of the acrylic resin, deformability during forming and mechanical strength during forming can be achieved.

Furthermore, according to an embodiment of the granulated powder of the present invention, the granulated powder may include a firing resin which reinforces the fired body after being fired. In this case, the soft magnetic powder, the firing resin, and the molding resin are combined into a granular form to constitute the granulated powder. As the firing resin, for example, a silicone resin is preferable. In the case of the silicone resin, both deformability during forming and mechanical strength after firing can be achieved.

[Dust Core]

A dust core of the present invention includes a plurality of soft magnetic particles and an insulating layer interposed between the soft magnetic particles. The soft magnetic particles used in the dust core are characterized by containing Fe, Si, and Al and satisfying the expressions (1) and (2) below:

$$27 \leq 2.5a+b \leq 29 \quad \text{Expression (1)}$$

$$6 \leq b \leq 9 \quad \text{Expression (2)}$$

where a character a represents the Si content (mass %) and a character b represents the Al content (mass %).

The dust core having the constitution described above has a low hysteresis loss in high-temperature ranges. In particular, preferably, a representing the Si content and b representing the Al content are further limited so as to satisfy the expressions (3) and (4) below:

$$978/35 \leq 18/7a+b \leq 1023/35 \quad \text{Expression (3)}$$

$$6.6 \leq b \leq 8.4 \quad \text{Expression (4)}$$

According to an embodiment of the dust core of the present invention, in the soft magnetic particles, preferably, the O content is less than 0.2 mass % (including 0 mass %), the Mn content is 0.3 mass % or less (including 0 mass %), and the Ni content is 0.3 mass % or less (including 0 mass %).

By limiting the O content, the Mn content, and the Ni content in the soft magnetic particles, the hysteresis loss of the dust core can be effectively reduced.

According to an embodiment of the dust core of the present invention, preferably, the insulating layer includes an inorganic insulating layer containing Si and O and being disposed on the surface of each of the soft magnetic particles.

Since the inorganic insulating layer is disposed on the surface of each particle, insulation between the soft magnetic particles can be secured. As a result, the eddy current loss of the dust core can be reduced.

A dust core of the present invention is characterized by being obtained by forming by pressing the granulated powder of the present invention into a compact, and heat-treating the compact.

By using the granulated powder in which the composition of the soft magnetic particles is limited, it is possible to produce a dust core having a small hysteresis loss in high-temperature ranges.

[Method for Producing Dust Core]

A method for producing a dust core according to the present invention in which a compact is formed using a soft magnetic powder, and the compact is fired to produce a dust core, the method being characterized by including a step of preparing the soft magnetic powder of the present invention, a step of mixing a molding resin for retaining the shape of the compact with the soft magnetic powder and forming a granulated powder, a step of compression-forming the granulated powder into a predetermined shape to produce a compact, and a step of firing the compact to produce a dust core.

According to this method, a dust core of the present invention can be easily obtained.

[Electromagnetic Component]

An electromagnetic component of the present invention is characterized by including the dust core of the present invention and a coil disposed outside the dust core, the coil being formed by winding a winding wire.

In such a constitution, it is possible to produce an electromagnetic component which has a dust core having a low hysteresis loss particularly at high temperatures and a relatively high magnetic permeability.

Advantageous Effects of Invention

According to the soft magnetic powder or the granulated powder of the present invention, it is possible to obtain a dust core having a low hysteresis loss at high frequencies in a high-temperature operating environment and having a relatively high magnetic permeability.

According to the dust core of the present invention, excellent properties are exhibited at high frequencies in a high-temperature operating environment.

According to the method for producing a dust core of the present invention, it is possible to easily produce a dust core which exhibits excellent properties at high frequencies in a high-temperature operating environment.

According to the electromagnetic component of the present invention, it is possible to constitute an inductor which exhibits excellent properties at high frequencies in a high-temperature operating environment.

DESCRIPTION OF EMBODIMENTS

Figure 1:
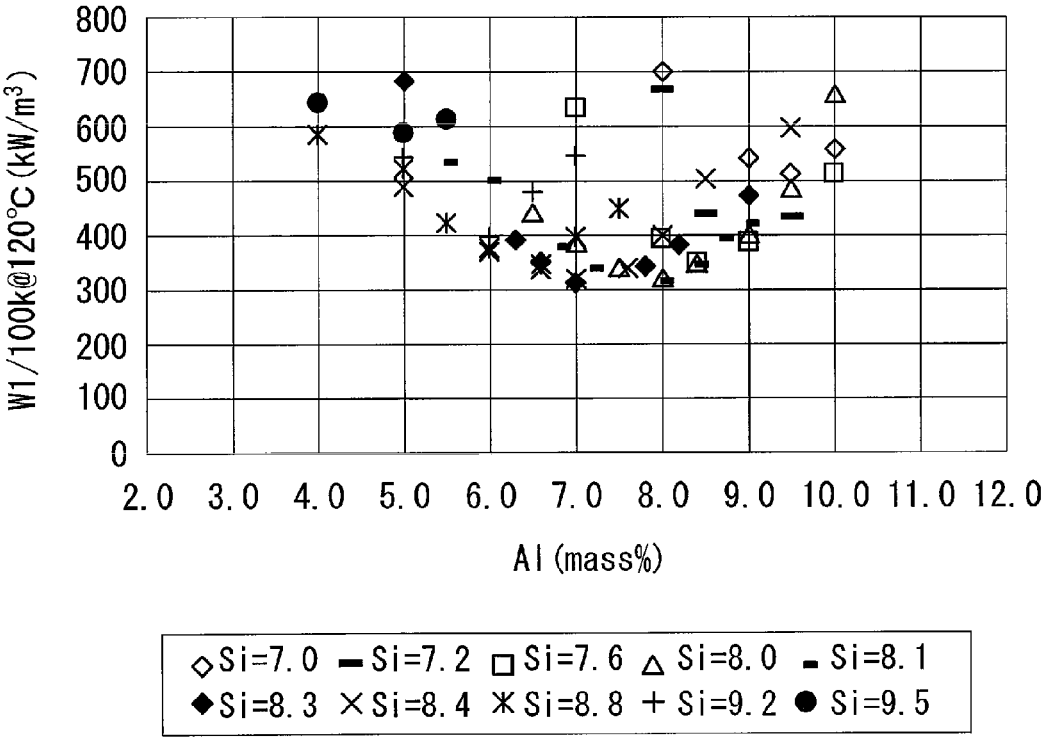
FIG. 1 is a graph showing the relationships between the Si content, the Al content, and the iron loss in dust cores fabricated in Example, in which the horizontal axis represents the Al content and the vertical axis represents the iron loss.

A soft magnetic powder, a granulated powder, a dust core, and an electromagnetic component according to the present invention will be described below in that order.

[Soft Magnetic Powder]

<Structure>

A soft magnetic powder of the present invention is an aggregate of composite magnetic particles, each including a soft magnetic particle and an insulating coating film disposed on the outer peripheral surface thereof.

(Soft Magnetic Particles)

Soft magnetic particles are composed of an Fe—Si—Al-based alloy, i.e., a sendust alloy. By limiting the Si content and the Al content in the soft magnetic particles, it is possible to obtain soft magnetic particles having a low hysteresis loss at high temperatures. Specifically, the expressions (1) and (2) below are satisfied:

$$27 \leq 2.5a+b \leq 29 \quad \text{Expression (1)}$$

$$6 \leq b \leq 9 \quad \text{Expression (2)}$$

where a character a represents the Si content (mass %) and a character b represents the Al content (mass %).

In the soft magnetic particles, more preferable contents a and b satisfy the expressions (3) and (4) below:

$$978/35 \leq 18/7a+b \leq 1023/35 \quad \text{Expression (3)}$$

$$6.6 \leq b \leq 8.4 \quad \text{Expression (4)}$$

Furthermore, O in the soft magnetic particles can be a factor that increases the hysteresis loss of the soft magnetic particles. Therefore, its content in the soft magnetic particles is preferably less than 0.2 mass %. The O content in the soft magnetic particles is more preferably 0.1 mass % or less, and most preferably 0 mass %.

Furthermore, in the soft magnetic particles, preferably, the Mn content and the Ni content are each 0.3 mass % or less. Mn and Ni can be factors that increase the hysteresis loss of the soft magnetic particles. Therefore, each of the Mn content and the Ni content is more preferably 0.2 mass % or less, and most preferably 0 mass %.

The soft magnetic particles are preferably produced by atomization, such as water atomization or gas atomization. Soft magnetic particles produced by water atomization have many irregularities on the surfaces of the particles, and therefore, because of interlocking of the irregularities, a fired body having high strength is easily obtained. On the other hand, soft magnetic particles produced by gas atomization have a substantially spherical particle shape, and therefore, the number of irregularities that may break through the insulating coating film is small, which is preferable. Furthermore, a natural oxide film may be formed on the surface of each of the soft magnetic particles.

(Insulating Coating Film)

The insulating coating film includes an inorganic insulating layer, for example, composed of an inorganic substance containing Si and O. The inorganic insulating film covers the outer peripheral surface of each of the soft magnetic particles, and thereby, insulation between the soft magnetic powder particles is secured. The inorganic insulating layer containing Si and O has high hardness. The inorganic insulating layer is not broken by applied pressure when a compact is formed by compressing a granulated powder using the soft magnetic powder in the subsequent step, or is not decomposed by heat when the compact is fired. As the inorganic substance containing Si and O, for example, $SiO_2$ can be typically used, and the $SiO_2$ may contain at least one of SiO and $Si_2O_3$. Furthermore, a silicate, such as sodium silicate (water glass), may also be used. Examples of the inorganic insulating layer composed of an inorganic substance containing Si and O include a coating film formed by heat-treating a silicone resin in an atmosphere containing oxygen, and a coating film formed by coating with water glass.

The thickness of the inorganic insulating layer is preferably set in the range of 20 nm to 1 μm. By setting the thickness to be higher than or equal to the lower limit, insulation between the soft magnetic particles can be secured and it is possible to form an inorganic insulating layer having a certain mechanical strength so as not to be broken by applied pressure during granulated powder compression. Furthermore, by setting the thickness to be lower than or equal to the upper limit, the amount of soft magnetic particles in a dust core can be sufficiently secured when the dust core is produced using the soft magnetic powder.

<Production Method>

The soft magnetic powder of the present invention is obtained by a production method mainly including steps of classification and insulating coating.

(Classification)

The particle size of soft magnetic particles in a dust core is preferably in the range of about 40 to 150 μm. Use of a powder having such a particle size is effective in suppressing an increase in eddy current loss when used in a high-frequency range of 1 kHz or more. Accordingly, it is preferable to perform a classification process so that the prepared soft magnetic powder is an aggregate of soft magnetic particles having a predetermined particle size. The classification may be performed, typically, using a sieve having a predetermined mesh size.

(Insulating Coating)

The soft magnetic powder, which is an aggregate of classified soft magnetic particles, is mixed with an insulating material. The insulating material is preferably a low-molecular-weight silicone resin or an aqueous solution of a silicate, such as water glass. The mixing is suitably performed using a mixer or the like. The mixing amount of the insulating material is preferably selected depending on the specific surface area of soft magnetic particles to be mixed. By determining the mixing amount of the insulating material depending on the specific surface area of the soft magnetic particles, it is possible to produce composite magnetic particles, each including a soft magnetic particle and an insulating coating film with a predetermined thickness disposed on the outer peripheral surface of the soft magnetic particle. The mixing amounts of the soft magnetic particles and the insulating material are set, for example, such that the amount of the insulating material is about 0.02 to 1.8 mass % on the basis of the mixture of the two, more preferably 0.05 to 1.5 mass %, and still more preferably 0.1 to 1.0 mass %.

When the insulating material is a silicone resin, it is preferable to perform heat treatment after coating to decompose and vitrify the silicone resin. The preferable heat treatment temperature is 400° C. to 1,000° C., and the more preferable heat treatment temperature is 600° C. to 900° C. Furthermore, the preferable heat treatment time is about 30 minutes to 2 hours.

When the insulating material is an aqueous solution of a silicate, only drying is performed at 50° C. to 100° C. after coating. Furthermore, the coating and granulation, which is the subsequent step, may be performed in succession, and handling is easy in comparison with the silicone resin.

[Granulated Powder]

<Structure>

The soft magnetic powder is further mixed with a molding resin and a firing resin to form a granulated powder. In the granulated powder, at least the molding resin and the soft magnetic powder are combined, and as necessary, the firing resin may also be combined therewith.

(Molding Resin)

The molding resin is a resin for retaining the shape of a compact when the soft magnetic powder is compressed into the compact. From the standpoint of achieving both deformability during forming and mechanical strength during forming, the molding resin is preferably a thermoplastic resin. Specific examples of the thermoplastic resin that can be used include, in addition to acrylic resins, polyvinyl alcohol, polyvinyl butyral, and polyethylene resins. The molding resin is eliminated at the time of firing the compact.

(Firing Resin)

When a compact obtained by compressing the soft magnetic powder is fired into a fired body, the firing resin is converted into a ceramic-based compound and serves as a shape-retaining agent which retains the soft magnetic powder. As the firing resin, typically, a silicone resin is used. It is assumed that the silicone resin is converted to an amorphous shape-retaining agent containing Si, C, and O in the firing process as will be described later, and the silicone resin is not eliminated after being fired.

<Production Method>

A granulated powder is produced by mixing a soft magnetic powder, a molding resin, and as necessary, a firing resin, using a mixer or the like. By this mixing, unit particles of a granulated powder are formed, each unit particle usually including several particles of the soft magnetic powder combined by the molding resin (which may include the firing resin, as necessary). The molding resin and the firing resin may be adjusted to a solution having an adequate viscosity using an appropriate solvent before being mixed with the soft magnetic powder.

The mixture of the soft magnetic powder and the molding resin (in the case where a firing resin is added, the mixture of the soft magnetic powder, the firing resin, and the molding resin) is preferably prepared by mixing such that the total of the resins to be added is 0.5 to 3 mass % of the mixture. By setting the resin content to be higher than or equal to the lower limit, the shape of the compact or fired body (i.e., dust core) can be sufficiently retained. On the other hand, by setting the resin content to be lower than or equal to the upper limit, an appropriate amount of resin is contained in the mixture, and the density of the compact or dust core can be increased.

[Compact]

<Structure>

A compact is an object in which the granulated powder is compacted into a predetermined shape. That is, the compact is in a state in which a soft magnetic powder is combined by a molding resin, and as necessary, by a firing resin. Since soft magnetic particles constituting the soft magnetic powder used are not substantially deformed by the pressure during forming, the inorganic insulating layer having high hardness formed on the outer periphery of each of the soft magnetic particles is also suppressed from being damaged. The shape of the compact may be selected depending on the shape of a magnetic core of an electromagnetic component.

<Production Method>

The compact is obtained by a method including a step of feeding a granulated powder into a die, and a step of pressing the granulated powder inside the die to form a compact.

In this method, the pressure for pressing the granulated powder is preferably about 10 to 12 ton/cm$^2$. By setting the pressure to be higher than or equal to the lower limit, it is possible to obtain a compact with high density. By setting the pressure to be lower than or equal to the higher limit, it is possible to suppress damage to the inorganic insulating layer due to deformation of the soft magnetic particles. Pressing can be performed at normal temperature. In the case where a thermoplastic resin is used as the molding resin, forming is preferably performed at a temperature equal to or higher than the glass transition temperature of the resin. Thereby, the density and strength of the compact can be improved.

[Dust Core]

<Structure>

A dust core of the present invention includes the soft magnetic particles and an insulating layer interposed between the soft magnetic particles.

The insulating layer interposed between the soft magnetic particles includes, as described above, an inorganic insulating layer composed of an inorganic substance containing Si and O disposed on the outer peripheral surface of each soft magnetic particle. The inorganic insulating layer on the surface of each particle remains substantially unchanged after being fired and secures insulation between soft magnetic powder particles reliably. Furthermore, in the case where a firing resin is used in producing the compact, on the outer periphery of the inorganic insulating layer (first layer) disposed on the surface of each soft magnetic particle, an inorganic insulating layer (second layer) obtained by heat-treating the firing resin is further formed. When the firing resin is a silicone resin, the second layer obtained by heat-treating the firing resin is also composed of an inorganic substance containing Si and O.

<Production Method>

Such a dust core is obtained by heat-treating the compact described above. The heating temperature in the heat treatment is preferably set at 600° C. to 900° C. Furthermore, the heating time is suitably about 30 minutes to 2 hours. The soft magnetic powder constituting the compact before being fired has a large amount of strain introduced therein. By heat-treating the compact under the conditions described above, the strain can be sufficiently removed. In addition, preferably, the atmosphere of the heat treatment is an inert gas atmosphere, such as a nitrogen atmosphere, or a reduced-pressure atmosphere.

[Electromagnetic Component]

An electromagnetic component of the present invention includes a magnetic core and a coil. The magnetic core includes the dust core described above. The magnetic core may be annular, rod-shaped, E-shaped, I-shaped, or the like. On the other hand, the coil is formed by winding a winding wire which includes a conductive wire and an insulating coating provided on the surface thereof. A winding wire having any of various cross-sectional shapes, such as a round or rectangular shape, can be used. For example, a round wire may be helically wound to constitute a cylindrical coil, and a rectangular wire may be helically wound edgewise to constitute a rectangular columnar coil.

The electromagnetic component may be formed by winding a winding wire around the outer periphery of the magnetic core, or by fitting an air core coil, which is helically wound in advance, in the outer periphery of the magnetic core.

Specific examples of the electromagnetic component include high-frequency choke coils, high-frequency tuning coils, bar antenna coils, power supply choke coils, power transformers, switching power transformers, reactors, and the like.

EXAMPLE 1

Under the conditions described below, magnetic powders were produced, granulated powders were formed, compacts were formed, and the compacts were sintered to produce test pieces of dust cores. Magnetic properties were evaluated on the test pieces.

<Production of Samples>

First, a plurality of soft magnetic powders having different compositions were prepared. A soft magnetic powder is an aggregate of soft magnetic particles. As shown in Tables I and II below, the composition of each soft magnetic powder is Fe-a mass % Si-b mass % Al (a=7.0 to 9.5; b=4.0 to 10.0). Furthermore, the soft magnetic particles constituting of the soft magnetic powders prepared had a substantially common average particle size of about 60 μm.

Next, each of the soft magnetic powders was mixed with a silicone resin using a mixer to form a silicone resin coating on each of the particles. The mixing amounts of the soft magnetic powder and the silicone resin were set such that the amount of the silicone resin was 0.3 mass % relative to the mixture of the two.

Subsequently, the soft magnetic powder coated with the silicone resin was subjected to heat treatment in an air atmosphere at 180° C.×1 hour to cure the resin. At this point, the silicone resin is not vitrified. Then, the soft magnetic powder coated with the silicone resin was passed through a sieve to loosen the agglomeration of particles.

Next, the resulting soft magnetic powder coated with the silicone resin was subjected to heat treatment in an air atmosphere at 600° C.×1 hour to vitrify the silicone resin coating, thereby forming an inorganic insulating layer composed of an inorganic substance containing Si and O. The thickness of the inorganic insulating layer is about 120 nm. When the soft magnetic powder provided with the inorganic insulating layer was obtained, disintegration is performed to break up the agglomeration of particles.

By the steps described above, soft magnetic powders were produced, each being an aggregate of composite magnetic particles, on the surface of each of which an inorganic insulating coating film containing Si and O was provided.

A molding resin and a firing resin were mixed with the resulting soft magnetic powder to produce a granulated powder. The mixing ratio of the soft magnetic powder, the molding resin, and the firing resin in the granulated powder were 100:1:0.5 (ratio by mass). An acrylic resin was used as the molding resin, and a silicone resin was used as the firing resin. The silicone resin is different from the silicone resin used for forming the inorganic insulating layer and is a high-molecular-weight silicone varnish mainly composed of polysiloxane.

Next, the granulated powder for each sample is fed into a die, followed by compression to produce a compact. The compressing pressure during compacting is 10 ton/cm$^2$. At this compressing pressure, the soft magnetic particles are not substantially deformed during forming.

Then, the resulting compact is subjected to heat treatment in a nitrogen atmosphere at 800° C.×1 hour to produce a dust core. In this process, it is assumed that the inorganic insulating coating film remains on the surfaces of particles without being decomposed, the molding resin is substantially eliminated, and the firing resin is converted to an amorphous material containing Si, C, and O. The test piece composed of the resulting dust core was ring-shaped with an outside diameter of 34 mm, an inside diameter of 20 mm, and a thickness of 5 mm.

<Evaluation>

Magnetic properties were measured on each of the samples produced as described above by the procedure shown below.

First, a winding wire was wound around each of the ring-shaped test pieces to obtain a measurement object in order to measure the magnetic properties of the test piece. The iron loss W1/100k@120° C. at an excitation flux density Bm of 1 kG (=0.1 T), a measurement frequency of 100 kHz, and an ambient temperature of 120° C. was measured on the measurement object using a B-H/μ analyzer SY8258 manufactured by Iwatsu Test Instruments Corporation. The results are shown in Tables I and II. The evaluation results of the samples are shown using the following symbols in the right end column of each table:

Solid triangle (▲): iron loss W1/100k@120° C. of 350 or less

Solid square (■): iron loss W1/100k@120° C. of more than 350 and 400 or less

Hollow diamond (◇): iron loss W1/100k@120° C. of more than 400

Iron loss is the sum of hysteresis loss and eddy current loss. In this example, since there is no difference other than the composition of soft magnetic particles between the samples, the magnitude of the iron loss can be considered as the magnitude of the hysteresis loss. Incidentally, it is also possible to calculate the hysteresis loss and the eddy current loss by fitting the iron loss-frequency curve by the method of least squares using the following three expressions:

(Iron loss)=(Hysteresis loss)+(Eddy current loss)

(Hysteresis loss)=(Hysteresis loss coefficient)×(Frequency)

(Eddy current loss)=(Eddy current loss coefficient)×(Frequency)

TABLE I

| Sample No. | Si (mass %) | Al (mass %) | O (mass %) | Mn (mass %) | Ni (mass %) | W1/100k (kW/m$^3$) | Evaluation |
|---|---|---|---|---|---|---|---|
| 1 | 7.0 | 8.0 | 0.01 | 0.01 | 0.01 | 701 | ◇ |
| 2 | 7.0 | 9.0 | 0.01 | 0.01 | 0.01 | 543 | ◇ |
| 3 | 7.0 | 9.5 | 0.01 | 0.01 | 0.01 | 509 | ◇ |
| 4 | 7.0 | 10.0 | 0.01 | 0.01 | 0.01 | 562 | ◇ |
| 5 | 7.2 | 8.0 | 0.01 | 0.01 | 0.01 | 668 | ◇ |
| 6 | 7.2 | 8.5 | 0.01 | 0.01 | 0.01 | 440 | ◇ |
| 7 | 7.2 | 9.0 | 0.01 | 0.01 | 0.01 | 381 | ■ |
| 8 | 7.2 | 9.5 | 0.01 | 0.01 | 0.01 | 433 | ◇ |
| 9 | 7.6 | 7.0 | 0.01 | 0.01 | 0.01 | 632 | ◇ |
| 10 | 7.6 | 8.0 | 0.01 | 0.01 | 0.01 | 395 | ■ |
| 11 | 7.6 | 8.4 | 0.01 | 0.01 | 0.01 | 347 | ▲ |
| 12 | 7.6 | 9.0 | 0.01 | 0.01 | 0.01 | 389 | ■ |
| 13 | 7.6 | 10.0 | 0.01 | 0.01 | 0.01 | 515 | ◇ |
| 14 | 8.0 | 6.5 | 0.01 | 0.01 | 0.01 | 440 | ◇ |
| 15 | 8.0 | 7.0 | 0.01 | 0.01 | 0.01 | 386 | ■ |
| 16 | 8.0 | 7.5 | 0.01 | 0.01 | 0.01 | 338 | ▲ |
| 17 | 8.0 | 8.0 | 0.01 | 0.01 | 0.01 | 321 | ▲ |
| 18 | 8.0 | 8.4 | 0.01 | 0.01 | 0.01 | 349 | ▲ |
| 19 | 8.0 | 9.0 | 0.01 | 0.01 | 0.01 | 399 | ■ |
| 20 | 8.0 | 9.5 | 0.01 | 0.01 | 0.01 | 485 | ◇ |
| 21 | 8.0 | 10.0 | 0.01 | 0.01 | 0.01 | 659 | ◇ |
| 22 | 8.1 | 5.5 | 0.01 | 0.01 | 0.01 | 532 | ◇ |

TABLE I-continued

| Sample No. | Si (mass %) | Al (mass %) | O (mass %) | Mn (mass %) | Ni (mass %) | W1/100k (kW/m$^3$) | Evaluation |
|---|---|---|---|---|---|---|---|
| 23 | 8.1 | 6.0 | 0.01 | 0.01 | 0.01 | 499 | ◇ |
| 24 | 8.1 | 6.8 | 0.01 | 0.01 | 0.01 | 378 | ■ |
| 25 | 8.1 | 7.2 | 0.01 | 0.01 | 0.01 | 339 | ▲ |
| 26 | 8.1 | 8.0 | 0.01 | 0.01 | 0.01 | 315 | ▲ |
| 27 | 8.1 | 8.4 | 0.01 | 0.01 | 0.01 | 345 | ▲ |
| 28 | 8.1 | 8.7 | 0.01 | 0.01 | 0.01 | 394 | ■ |
| 29 | 8.1 | 9.0 | 0.01 | 0.01 | 0.01 | 422 | ◇ |
| 30 | 8.3 | 5.0 | 0.01 | 0.01 | 0.01 | 681 | ◇ |
| 31 | 8.3 | 6.3 | 0.01 | 0.01 | 0.01 | 392 | ■ |
| 32 | 8.3 | 6.6 | 0.01 | 0.01 | 0.01 | 348 | ▲ |
| 33 | 8.3 | 7.0 | 0.01 | 0.01 | 0.01 | 312 | ▲ |
| 34 | 8.3 | 7.8 | 0.01 | 0.01 | 0.01 | 343 | ▲ |
| 35 | 8.3 | 8.2 | 0.01 | 0.01 | 0.01 | 381 | ■ |

TABLE II

| Sample No. | Si (mass %) | Al (mass %) | O (mass %) | Mn (mass %) | Ni (mass %) | W1/100k (kw/m$^3$) | Evaluation |
|---|---|---|---|---|---|---|---|
| 36 | 8.3 | 9.0 | 0.01 | 0.01 | 0.01 | 474 | ◇ |
| 37 | 8.4 | 5.0 | 0.01 | 0.01 | 0.01 | 488 | ◇ |
| 38 | 8.4 | 6.0 | 0.01 | 0.01 | 0.01 | 371 | ■ |
| 39 | 8.4 | 6.6 | 0.01 | 0.01 | 0.01 | 336 | ▲ |
| 40 | 8.4 | 7.0 | 0.01 | 0.01 | 0.01 | 317 | ▲ |
| 41 | 8.4 | 7.6 | 0.01 | 0.01 | 0.01 | 340 | ▲ |
| 42 | 8.4 | 8.0 | 0.01 | 0.01 | 0.01 | 399 | ■ |
| 43 | 8.4 | 8.5 | 0.01 | 0.01 | 0.01 | 502 | ◇ |
| 44 | 8.4 | 9.5 | 0.01 | 0.01 | 0.01 | 598 | ◇ |
| 45 | 8.8 | 4.0 | 0.01 | 0.01 | 0.01 | 586 | ◇ |
| 46 | 8.8 | 5.0 | 0.01 | 0.01 | 0.01 | 522 | ◇ |
| 47 | 8.8 | 5.5 | 0.01 | 0.01 | 0.01 | 421 | ◇ |
| 48 | 8.8 | 6.0 | 0.01 | 0.01 | 0.01 | 377 | ■ |
| 49 | 8.8 | 6.6 | 0.01 | 0.01 | 0.01 | 344 | ▲ |
| 50 | 8.8 | 7.0 | 0.01 | 0.01 | 0.01 | 398 | ■ |
| 51 | 8.8 | 7.5 | 0.01 | 0.01 | 0.01 | 450 | ◇ |
| 52 | 9.2 | 5.0 | 0.01 | 0.01 | 0.01 | 542 | ◇ |
| 53 | 9.2 | 6.0 | 0.01 | 0.01 | 0.01 | 398 | ■ |
| 54 | 9.2 | 6.5 | 0.01 | 0.01 | 0.01 | 479 | ◇ |
| 55 | 9.2 | 7.0 | 0.01 | 0.01 | 0.01 | 545 | ◇ |
| 56 | 9.5 | 4.0 | 0.01 | 0.01 | 0.01 | 641 | ◇ |
| 57 | 9.5 | 5.0 | 0.01 | 0.01 | 0.01 | 589 | ◇ |
| 58 | 9.5 | 5.5 | 0.01 | 0.01 | 0.01 | 612 | ◇ |
| 59 | 8.0 | 8.0 | 0.1 | 0.01 | 0.01 | 342 | ▲ |
| 60 | 8.0 | 8.0 | 0.15 | 0.01 | 0.01 | 369 | ■ |
| 61 | 8.0 | 8.0 | 0.19 | 0.01 | 0.01 | 384 | ■ |
| 62 | 8.0 | 8.0 | 0.2 | 0.01 | 0.01 | 411 | ◇ |
| 63 | 8.0 | 8.0 | 0.01 | 0.2 | 0.01 | 337 | ▲ |
| 64 | 8.0 | 8.0 | 0.01 | 0.3 | 0.01 | 398 | ■ |
| 65 | 8.0 | 8.0 | 0.01 | 0.4 | 0.01 | 406 | ◇ |
| 66 | 8.0 | 8.0 | 0.01 | 0.01 | 0.2 | 346 | ▲ |
| 67 | 8.0 | 8.0 | 0.01 | 0.01 | 0.3 | 397 | ■ |
| 68 | 8.0 | 8.0 | 0.01 | 0.01 | 0.4 | 404 | ◇ |

Figure 2:
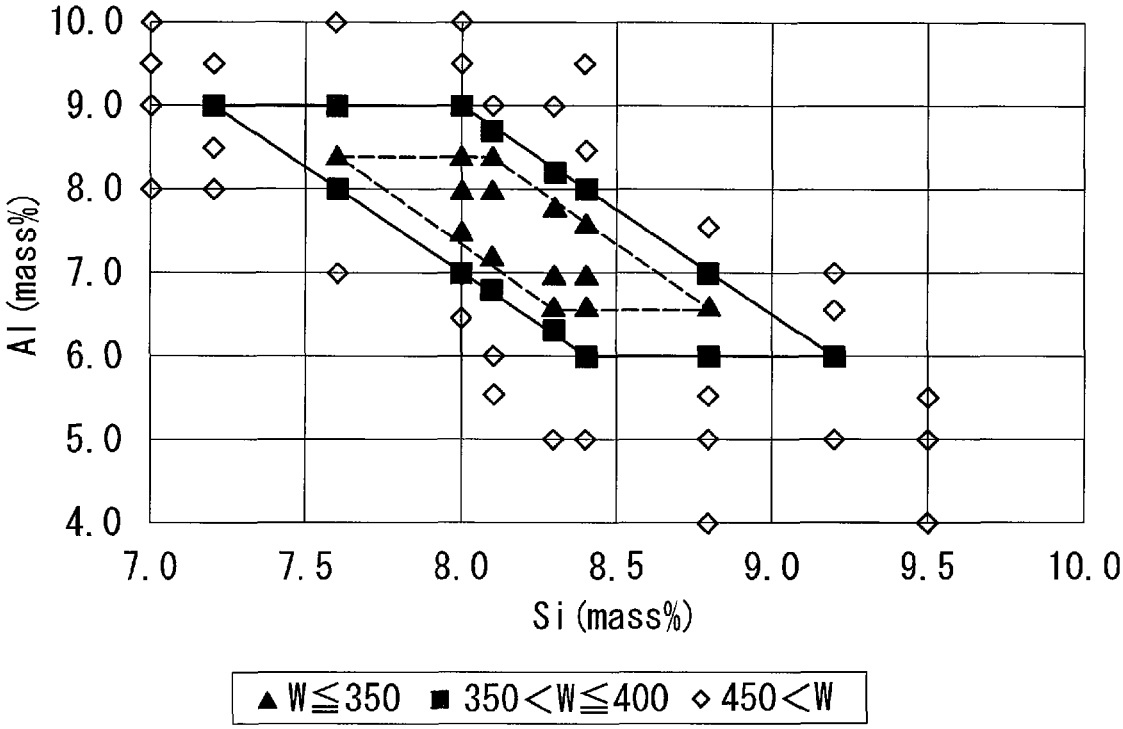
FIG. 2 is a graph showing the relationships between the Si content, the Al content, and the iron loss in duct cores fabricated in Example, in which the horizontal axis represents the Si content and the vertical axis represents the Al content.

First, the results of Samples 1 to 58 shown in Tables I and II were plotted in the graph of FIG. 1, in which the horizontal axis represents the Al content and the vertical axis represents the iron loss W1/100k@120° C. As is clear from the graph, the iron loss W1/100k@120° C. tends to decrease when the Al content is in the range of about 6.0 to 9.0. However, depending on the Si content, in some cases, the iron loss W1/100k@120° C. exceeds 700. Then, the measurement results were plotted in the graph of FIG. 2, in which the horizontal axis represents the Al content and the vertical axis represents the Si content (the symbols for plotting being in common with those in Tables I and II). As is clear from the results of FIG. 2, regarding the samples within a parallelogram shown by the solid line, which satisfy the expressions $27 \leq 2.5a+b \leq 29$ and $6 \leq b \leq 9$, where a character a represents the Si content (mass %) and a character b represents the Al content (mass %), among Samples 1 to 58 (the contents of O, Mn, and Ni are each 0.01 mass %), the iron loss W1/100k@120° C. is 400 or less. Furthermore, among Samples 1 to 58, regarding the samples within a parallelogram shown by the dashed line, in which a and b satisfy the expressions $978/35 \leq 18/7a+b \leq 1023/35$ and $6.6 \leq b \leq 8.4$, the iron loss W1/100k@120° C. is 350 or less.

Next, comparison of Sample 17 in Table I with Samples 59 to 68 in Table II indicates that as the contents of O, Mn, and Ni decrease, the iron loss W1/100k@120° C. decreases. In Samples 62, 65, and 68, the iron loss W1/100k@120° C. exceeds 400, but is lower than the iron loss W1/100k@120° C. of the other samples under the evaluation criterion "hollow diamond (◇)".

EXAMPLE 2

First, a soft magnetic powder having a composition of Fe-8.0 mass % Si-8.0 mass % Al (the contents of O, Mn, and Ni in the soft magnetic powder are each 0.01 mass %) and an aqueous solution containing, as a main component, potassium silicate were prepared. The average particle size of the soft magnetic powder was about 60 μm. The potassium silicate concentration in the aqueous solution was 30 mass %. The soft magnetic powder and the aqueous solution were mixed with a mixer, and thereby, an inorganic insulating layer mainly composed of potassium silicate was formed on the surface of each of soft magnetic particles. The mixing amounts of the soft magnetic powder and the aqueous solution were set such that the solid content in the aqueous solution was 0.3 mass % on the basis of the mixture of the two.

Next, a molding resin was mixed with the resulting soft magnetic powder to produce a granulated powder. The mixing ratio of the soft magnetic powder and the molding resin in the granulated powder was 100:1 (ratio by mass). An acrylic resin was used as the molding resin. Subsequently, the granulated powder was fed into a die, followed by compression to produce a compact. The compressing pressure during compacting is 10 ton/cm$^2$. Then, the resulting compact was subjected to heat treatment in a nitrogen atmosphere at 775° C.×1 hour to produce a dust core. The test piece composed of the resulting dust core was ring-shaped with an outside diameter of 34 mm, an inside diameter of 20 mm, and a thickness of 5 mm.

A winding wire was wound around the resulting test piece to obtain a measurement object (Sample 69) in order to measure the magnetic properties of the test piece. The iron loss W1/100k@120° C. was measured on Sample 69 by the same method as that in Example 1. As a result, as shown in Table III, the iron loss W1/100k@120° C. of Sample 69 is 350 or less, indicating that the energy loss of Sample 69 is low.

TABLE III

| Sample No | Si (mass %) | Al (mass %) | O (mass %) | Mn (mass %) | Ni (mass %) | W1/100k (kW/m$^3$) | Evaluation |
|---|---|---|---|---|---|---|---|
| 69 | 8.0 | 8.0 | 0.01 | 0.01 | 0.01 | 310 | ▲ |

The results described above show that when a sendust alloy having the Si content and the Al content which are specified in the present invention is used, it is possible to produce a dust core in which an energy loss is low under a high-temperature environment at 120° C.

It is to be understood that embodiments of the present invention are not limited to the examples described above. Various modifications are possible within a range not departing from the gist of the present invention.

Industrial Applicability

The soft magnetic powder, the granulated powder, and the method for producing a dust core according to the present invention can be suitably used for obtaining dust cores used for various inductors. Furthermore, electromagnetic components of the present invention can be suitably used for high-frequency choke coils, high-frequency tuning coils, bar antenna coils, power supply choke coils, power transformers, switching power transformers, reactors, and the like.

The invention claimed is:

1. A soft magnetic powder comprising an aggregate of composite magnetic particles, each including a soft magnetic particle containing Fe, Si, and Al, and an insulating coating film disposed on a surface thereof, wherein the soft magnetic powder satisfying the expressions:

$$978/35 \leq 18/7a + b \leq 1023/35 \text{ and } 6.6 \leq b \leq 8.4,$$

where a character a represents the Si content (mass %) and a character b represents the Al content (mass %) in the soft magnetic particles.

2. The soft magnetic powder according to claim 1, wherein the soft magnetic particles including less than 0.2 mass % of O, 0.3 mass % or less of Mn, and 0.3 mass % or less of Ni.

3. The soft magnetic powder according to claim 1, wherein the insulating coating film including an inorganic insulating layer composed of an inorganic substance containing Si and O.

4. A granulated powder which is formed into a compact by pressing, the compact being fired into a dust core, comprising:

the soft magnetic powder according to claim 1; and a molding resin which serves as a shape-retaining agent during forming to retain the shape of the compact, wherein the soft magnetic powder and the molding resin being combined into a granular form.

5. The granulated powder according to claim 4, wherein the molding resin containing an acrylic resin.

6. A dust core obtained by pressing the granulated powder according to claim 4 into a compact, and heat-treating the compact.

7. A method for producing a dust core in which a compact is formed using a soft magnetic powder, and the compact is fired to produce the dust core, comprising a step of:

preparing the soft magnetic powder according to claim 1;

mixing a molding resin for retaining the shape of the compact with the soft magnetic powder and forming a granulated powder;

compression-forming the granulated powder into a predetermined shape to produce the compact; and firing the compact to produce the dust core.

8. A dust core comprising a plurality of soft magnetic particles and an insulating layer interposed between the soft magnetic particles, wherein the soft magnetic particles containing Fe, Si, and Al and satisfying the expressions:

$$978/35 \leq 18/7a + b \leq 1023/35 \text{ and } 6.6 \leq b \leq 8.4,$$

where a character a represents the Si content (mass %) and a character b represents the Al content (mass %).

9. The dust core according to claim 8, wherein the soft magnetic particles containing less than 0.2 mass % of O, 0.3 mass % or less of Mn, and 0.3 mass % or less of Ni.

10. The dust core according to claim 8, wherein the insulating layer including an inorganic insulating layer containing Si and O and disposed on the surface of each of the soft magnetic particles.

11. An electromagnetic component comprising:

the dust core according to claim 8; and a coil disposed outside of the dust core, the coil being formed by winding a winding wire.

* * * * *